US010969182B2

(12) United States Patent
Fellows

(10) Patent No.: US 10,969,182 B2
(45) Date of Patent: Apr. 6, 2021

(54) SEMI-AUTOMATIC RIMFIRE RIFLE

(71) Applicant: Franklin Armory Holdings, Inc., Minden, NV (US)

(72) Inventor: Ryan Paul Fellows, San Jose, CA (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 15/665,836

(22) Filed: Aug. 1, 2017

(65) Prior Publication Data

US 2017/0343309 A1 Nov. 30, 2017

Related U.S. Application Data

(63) Continuation of application No. 15/234,279, filed on Aug. 11, 2016, now Pat. No. 9,746,262, which is a continuation of application No. 14/615,864, filed on Feb. 6, 2015, now Pat. No. 9,429,379.

(60) Provisional application No. 61/937,636, filed on Feb. 10, 2014.

(51) Int. Cl.

| | |
|---|---|
| ***F41A 3/26*** | (2006.01) |
| ***F41A 19/27*** | (2006.01) |
| ***F41A 15/14*** | (2006.01) |
| ***F42B 5/32*** | (2006.01) |
| ***F41A 19/13*** | (2006.01) |
| ***F41A 19/25*** | (2006.01) |

(52) U.S. Cl.

CPC ..... *F41A 3/26* (2013.01); *F41A 15/14* (2013.01); *F41A 19/13* (2013.01); *F41A 19/25* (2013.01); *F41A 19/27* (2013.01); *F42B 5/32* (2013.01)

(58) Field of Classification Search

CPC .. F41A 3/26; F41A 15/14; F41A 19/13; F41A 19/25; F41A 19/27; F42B 5/32

USPC ..... 42/16

See application file for complete search history.

(56) References Cited

U.S. PATENT DOCUMENTS 351,333 A * 10/1886 Morris ..... F41A 21/10 89/29

529,455 A * 11/1894 Marlin ..... F41A 11/04 42/75.02

(Continued)

OTHER PUBLICATIONS

John Jay, "[A]n ar-15 platform bolt w/ a .473" bolt face . . . an idea whose time has come, and which is now reality . . . ," http://wintersoldier2008.typepad.com/summer_patriot_winter_sol/2012/08/page/2/, Aug. 23, 2012, Accessed Jan. 5, 2015.

*Primary Examiner* — Michelle Clement

(74) *Attorney, Agent, or Firm* — Bennet K. Langlotz; Langlotz Patent & Trademark Works, LLC

(57) ABSTRACT

Semi-automatic rimfire rifles have a frame, a bolt operable to reciprocate within the frame, the bolt defining a bolt axis, the bolt defining a firing pin passage, a first firing pin portion received within at least a first portion of the firing pin passage, a second firing pin portion separate from the first firing pin portion received within at least a second portion of the firing pin passage, and the first firing pin portion being operable to contact the second firing pin portion such that the second firing pin portion discharges a cartridge in response to the first firing pin portion being struck by a hammer. The first firing pin portion may define a first firing pin axis aligned with the bolt axis. The second firing pin portion may have a nose portion that is offset from the bolt axis extending away from the first firing pin portion.

6 Claims, 14 Drawing Sheets

(56) References Cited

U.S. PATENT DOCUMENTS 1,234,783 A * 7/1917 Mauser ..... F41A 21/482 42/75.02
1,393,057 A * 10/1921 Vollmer ..... F41A 21/482 285/347
1,494,524 A * 5/1924 Adamson ..... F41A 21/00 285/391
2,918,847 A * 12/1959 Barr ..... F41A 5/26 42/25
3,611,611 A * 10/1971 Quinney ..... F41A 21/482 42/75.02
3,641,869 A * 2/1972 Buchanan ..... F41A 21/12 42/1.07
3,776,095 A * 12/1973 Atchisson ..... F41A 11/02 42/16
3,834,053 A * 9/1974 Bielfeldt ..... F41A 21/482 42/1.07
3,842,527 A * 10/1974 Low ..... F41A 21/482 42/75.02
3,858,342 A * 1/1975 Langsford ..... F41A 21/12 42/16
3,877,167 A * 4/1975 Keppeler ..... F41A 21/482 42/75.02
4,058,922 A * 11/1977 Elbe ..... F41A 9/71 42/16
4,126,077 A * 11/1978 Quesnel ..... F41A 21/28 42/1.06
4,288,938 A * 9/1981 Kahn ..... F41A 21/488 42/59
4,297,801 A * 11/1981 Kahn ..... F41A 21/482 42/59
4,459,774 A * 7/1984 Ferretti ..... F41A 21/10 42/77
4,506,604 A * 3/1985 Hughes ..... F42B 8/10 102/446
4,531,446 A * 7/1985 VanVoorhees ..... F41A 11/02 89/145
4,615,132 A * 10/1986 Smith ..... F41A 3/12 42/136
4,955,157 A * 9/1990 Brighton ..... F41A 11/02 102/446
5,410,834 A * 5/1995 Benton ..... F41A 21/482 42/75.02
5,448,848 A * 9/1995 Moller ..... F41A 21/02 42/77
5,479,737 A * 1/1996 Osborne ..... F41A 21/12 42/76.01
5,666,756 A * 9/1997 Moller ..... F41A 21/10 42/47
5,937,563 A * 8/1999 Schuetz ..... F41A 21/28 42/106
6,205,696 B1 * 3/2001 Bilgeri ..... F41A 21/487 42/75.02
6,655,372 B1 * 12/2003 Field ..... F41A 21/484 124/83
7,062,875 B1 * 6/2006 Stevens ..... F41A 11/00 42/77
7,076,904 B1 * 7/2006 Rustick ..... F41A 21/482 42/75.01
8,215,221 B2 * 7/2012 Lawitzke ..... F41A 21/481 42/76.01
8,782,943 B2 * 7/2014 Jarboe ..... F41A 21/485 42/75.02
8,984,758 B2 * 3/2015 Williamson, IV ..... G01B 3/28 33/506
9,383,154 B2 * 7/2016 Stone ..... F41A 21/481
9,541,343 B2 * 1/2017 Dodson ..... F41A 21/12
9,921,019 B2 * 3/2018 Stone ..... F41A 21/481
2005/0188591 A1 * 9/2005 Stone ..... F41A 21/485 42/75.02
2010/0175290 A1 * 7/2010 Duplessis ..... F41A 3/22 42/16
2012/0137558 A1 * 6/2012 Lizarralde Ibarguren ..... F41A 3/30 42/51
2013/0291420 A1 * 11/2013 Aalto ..... F41A 21/48 42/75.02
2016/0033226 A1 * 2/2016 Potter ..... F41A 3/30 42/76.01

* cited by examiner

SEMI-AUTOMATIC RIMFIRE RIFLE

CROSS-REFERENCE TO RELATED APPLICATION

This application is a Continuation of U.S. patent application Ser. No. 15/234,279 filed on Aug. 11, 2016, entitled "RIMFIRE RIFLE," which is a Continuation of U.S. patent application Ser. No. 14/615,864 filed on Feb. 6, 2015, entitled "RIMFIRE RIFLE," which claims the benefit of U.S. Provisional Patent Application No. 61/937,636 filed on Feb. 10, 2014, entitled "F17-L RIMFIRE RIFLE," which are hereby incorporated by reference in their entirety for all that is taught and disclosed therein.

FIELD OF THE INVENTION

The present invention relates to firearms, and more particularly to a gas-powered, semi-automatic rimfire rifle.

BACKGROUND OF THE INVENTION

Modern firearms utilize cartridges, which are a single unit of ammunition that combine a bullet, a propellant, and a primer within a cartridge case. The primer is a small charge of an impact-sensitive chemical mixture. The method of ignition of the primer is used to describe the type of cartridge. Rimfire ammunition locates the primer inside a rim, and centerfire ammunition locates the primer at the center of the case head. Generally, centerfire rifle cartridges are more powerful than rimfire cartridges, but centerfire rifle cartridges are significantly more expensive to purchase than rimfire cartridges. Rimfire firearms are also subjected to fewer legal restrictions in many jurisdictions relative to centerfire firearms.

Typically, semi-automatic rifles allow the shooter to shoot only the caliber of bullet and the type of cartridge the rifle is sized to receive. However, it is often desirable for shooters to be able to practice shooting with less powerful and/or less expensive ammunition. Lower power rimfire ammunition allows a shooter to become familiar with the feel of the firearm while shooting a round that has less recoil and is considerably cheaper than centerfire ammunition. In addition, the reduced power of the rimfire ammunition allows it to be shot at smaller range facilities. For example, many shooting ranges, particularly indoor ranges, which explicitly prohibit the use of centerfire rifles allow the use of rimfire rifles. However, accommodating a rimfire cartridge in a semi-automatic rifle designed to receive a centerfire cartridge creates a challenge to retaining the rifle's original fire control group and lower receiver because the firing pin must strike the rim of the cartridge rather than the center.

Therefore, a need exists for a new and improved semi-automatic rimfire rifle that converts a semi-automatic rifle from a centerfire caliber to a rimfire caliber while retaining the rifle's original fire control group and lower receiver. In this regard, the various embodiments of the present invention substantially fulfill at least some of these needs. In this respect, the semi-automatic rimfire rifle according to the present invention substantially departs from the conventional concepts and designs of the prior art, and in doing so provides an apparatus primarily developed for the purpose of providing a semi-automatic rimfire rifle that converts a semi-automatic rifle from a centerfire caliber to a rimfire caliber while retaining the rifle's original fire control group and lower receiver.

SUMMARY OF THE INVENTION

The present invention provides an improved semi-automatic rimfire rifle, and overcomes the above-mentioned disadvantages and drawbacks of the prior art. As such, the general purpose of the present invention, which will be described subsequently in greater detail, is to provide an improved semi-automatic rimfire rifle that has all the advantages of the prior art mentioned above.

To attain this, the preferred embodiment of the present invention essentially comprises a frame, a bolt operable to reciprocate within the frame, the bolt defining a bolt axis, the bolt defining a firing pin passage, a first firing pin portion received within at least a first portion of the firing pin passage, a second firing pin portion separate from the first firing pin portion received within at least a second portion of the firing pin passage, and the first firing pin portion being operable to contact the second firing pin portion such that the second firing pin portion discharges a cartridge in response to the first firing pin portion being struck by a hammer. The first firing pin portion may define a first firing pin axis aligned with the bolt axis. The second firing pin portion may have a nose portion that is offset from the bolt axis extending away from the first firing pin portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
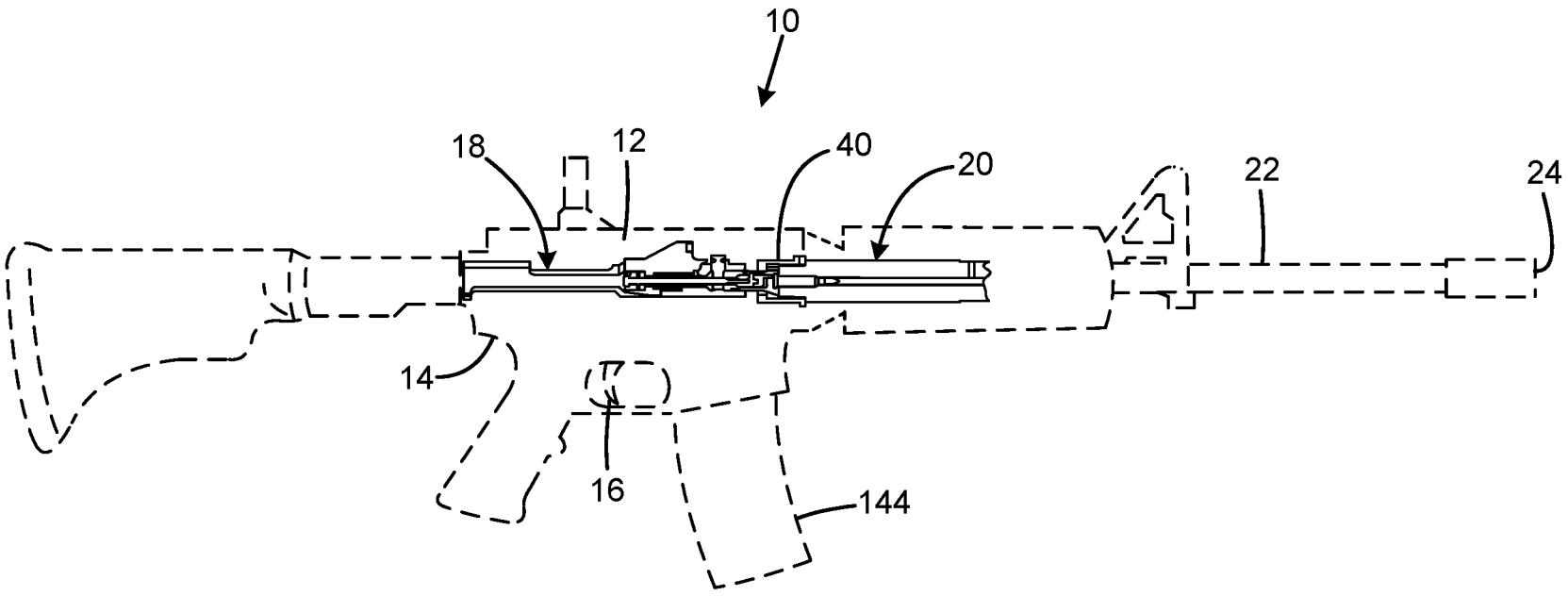
FIG. 1 is a right side sectional view of the semi-automatic rimfire rifle constructed in accordance with the principles of the present invention.

An embodiment of the semi-automatic rimfire rifle of the present invention is shown and generally designated by the reference numeral 10.

FIG. 1 illustrates the improved semi-automatic rimfire rifle 10 of the present invention. More particularly, the semi-automatic rimfire rifle 10 has an upper receiver 12 connected to a lower receiver 14. The lower receiver receives a magazine 144 and contains the fire control group. The fire control group is the part of a firearm responsible for the motion of the trigger, its potential to be stopped by the safety, and the eventual release of the hammer or striker. It is generally composed of the hammer or striker, the trigger, the disconnector, and the sear. In FIG. 1, only the trigger 16 portion of the fire control group is visible. In the current embodiment, the lower receiver and fire control group are those of a standard AR-15 rifle.

The upper receiver 12 contains a bolt carrier assembly 18 and receives one end of a barrel assembly 20, which includes a barrel extension 40 attached to the rear end of a barrel 22. The forward end of the barrel extends in front of the upper receiver and terminates in a muzzle 24. In the current embodiment, the upper receiver is that of a standard AR-15 rifle.

Figure 2:
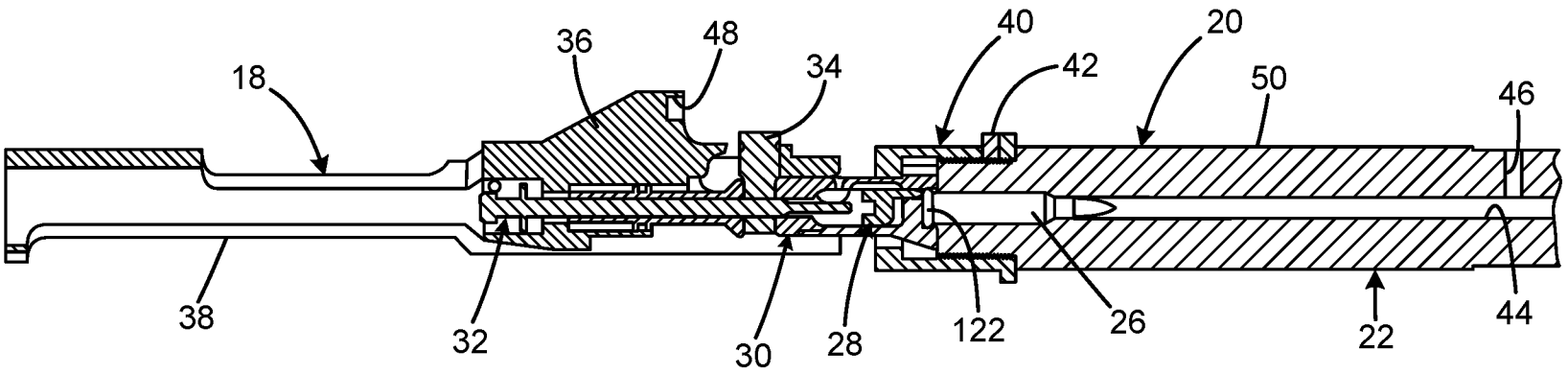
FIG. 2 is an enlarged right side sectional view of the bolt carrier assembly and barrel assembly of FIG. 1.

FIG. 2 illustrates the improved bolt carrier assembly 18 and barrel assembly 20 of the present invention. More particularly, the barrel assembly is shown in a loaded condition at the moment of ignition. A cartridge 26 having a rim 122 is received in the rear end of a barrel bore 44 in the barrel 22. An offset firing pin 28 has contacted the rim of the cartridge. A gas port 46 communicates between the barrel bore and the exterior 50 of the barrel. In the current embodiment, the cartridge is a .17 Winchester® Super Magnum cartridge manufactured by Winchester Ammunition of East Alton, Ill., which is currently the most powerful rimfire cartridge produced.

The bolt carrier assembly 18 includes a bolt carrier 38, a cam pin 34, a primary firing pin 32, a bolt 30, a forward facing solid tubular protrusion 36 attached to the bolt, and an offset firing pin 28. The tubular protrusion includes a forward facing aperture 48. A piston-driven operating rod with one end received in the aperture utilizes a portion of the energy from the combustion gases directed through gas port 46 in the barrel 22 to propel the bolt carrier rearward. The operating rod is omitted for clarity. The bolt carrier is free to reciprocate within the upper receiver 12, and the bolt is free to reciprocate within the bolt carrier.

Figure 3:
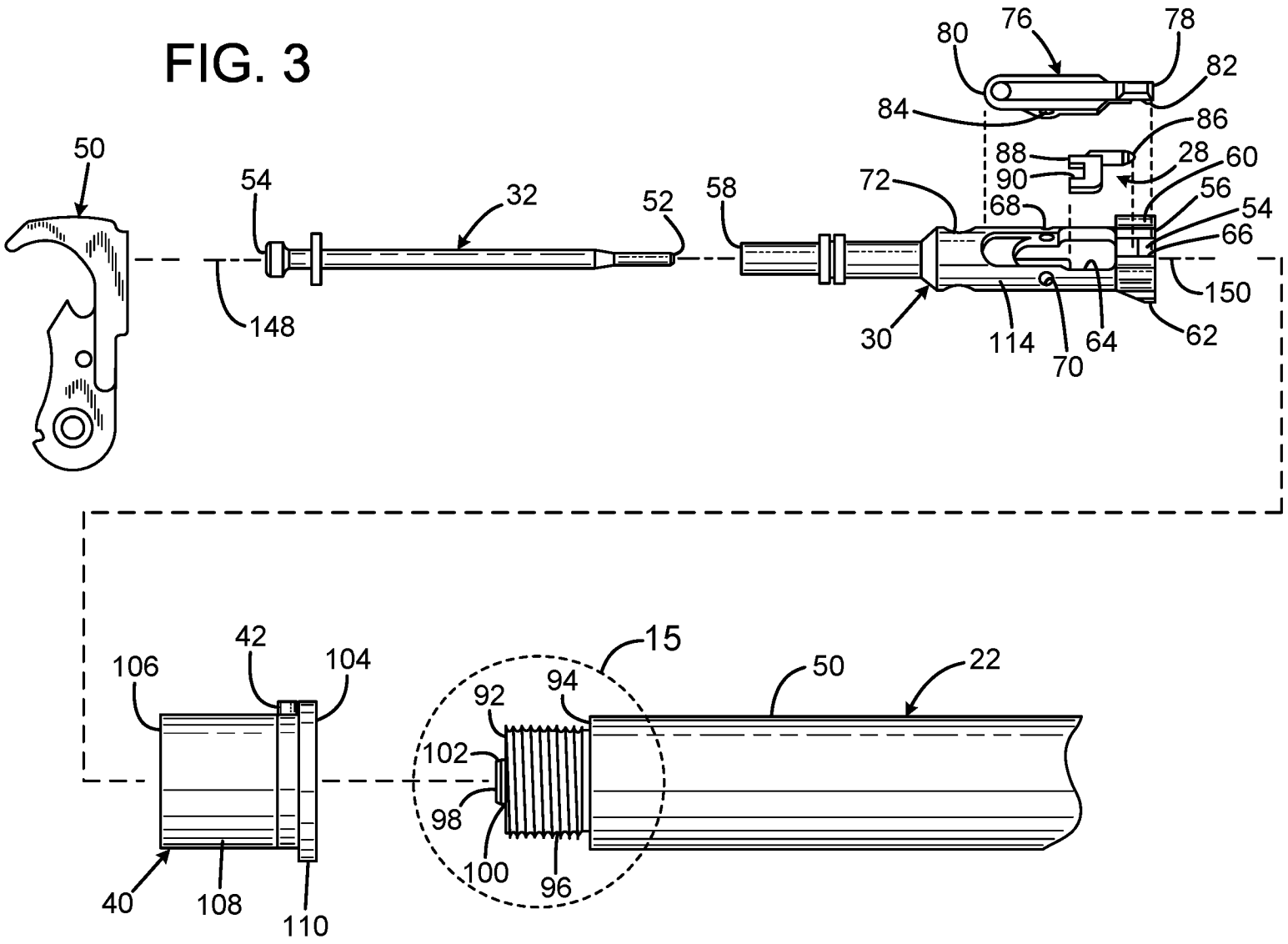
FIG. 3 is a right side exploded view of the primary firing pin, offset firing pin, bolt, and barrel assembly, and a prior art hammer from an AR-15 rifle for the semi-automatic rimfire rifle of FIG. 1.
Figure 4:
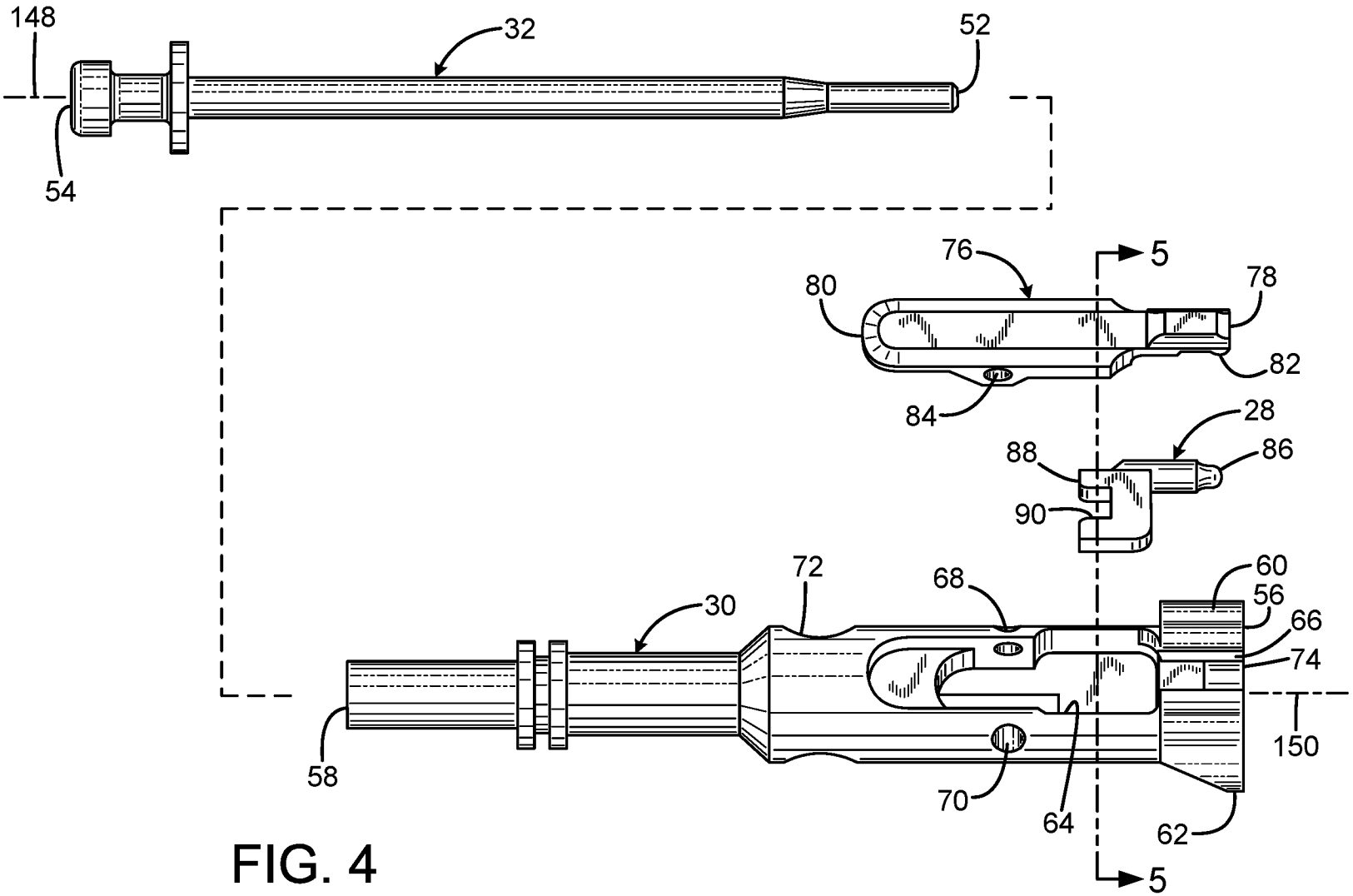
FIG. 4 is an enlarged right side exploded view of the primary firing pin, offset firing pin, and bolt of FIG. 3.

FIGS. 3-8, 10 and 11 illustrate the improved barrel 22, offset firing pin 28, bolt 30, primary firing pin 32, and barrel extension 40 of the present invention. FIG. 3 also includes a hammer 50, which is that of a standard AR-15 rifle in the current embodiment. The bolt has a front 56 and a rear 58. The front includes five lugs 60, a bottom lug 62, an extractor slot 66, a bolt face recess 74, an ejector 112 protruding from an ejector aperture 146, an offset firing pin bore 118 (also shown in FIG. 11), a bolt face 120, and defines a bolt axis 150. The exterior of the bolt defines an extractor recess 64 in communication with the extractor slot, axially aligned bores 68, 70 in communication with the recess, and a vertical cam pin bore 72 that receives the cam pin 34. The axial primary firing pin bore 116 extends from the offset firing pin bore to the rear of the bolt.

An extractor 76 is received within the extractor recess 64 and extractor slot 66 in the bolt 30. The extractor has a front 78 and the rear 80. A hook 82 extends from the front of the extractor towards the center of the bolt. The extractor includes a longitudinal bore 84 that is axially registered with the bore 68, 70 in the bolt such that a pin (not shown) inserted through bores 68, 70, 84 pivotally mounts the extractor within the extractor recess. The bolt face recess 74 allows the extractor to be recessed completely within the bolt 30 so the extractor cannot interfere with feeding, which enhances reliability.

Figure 5:
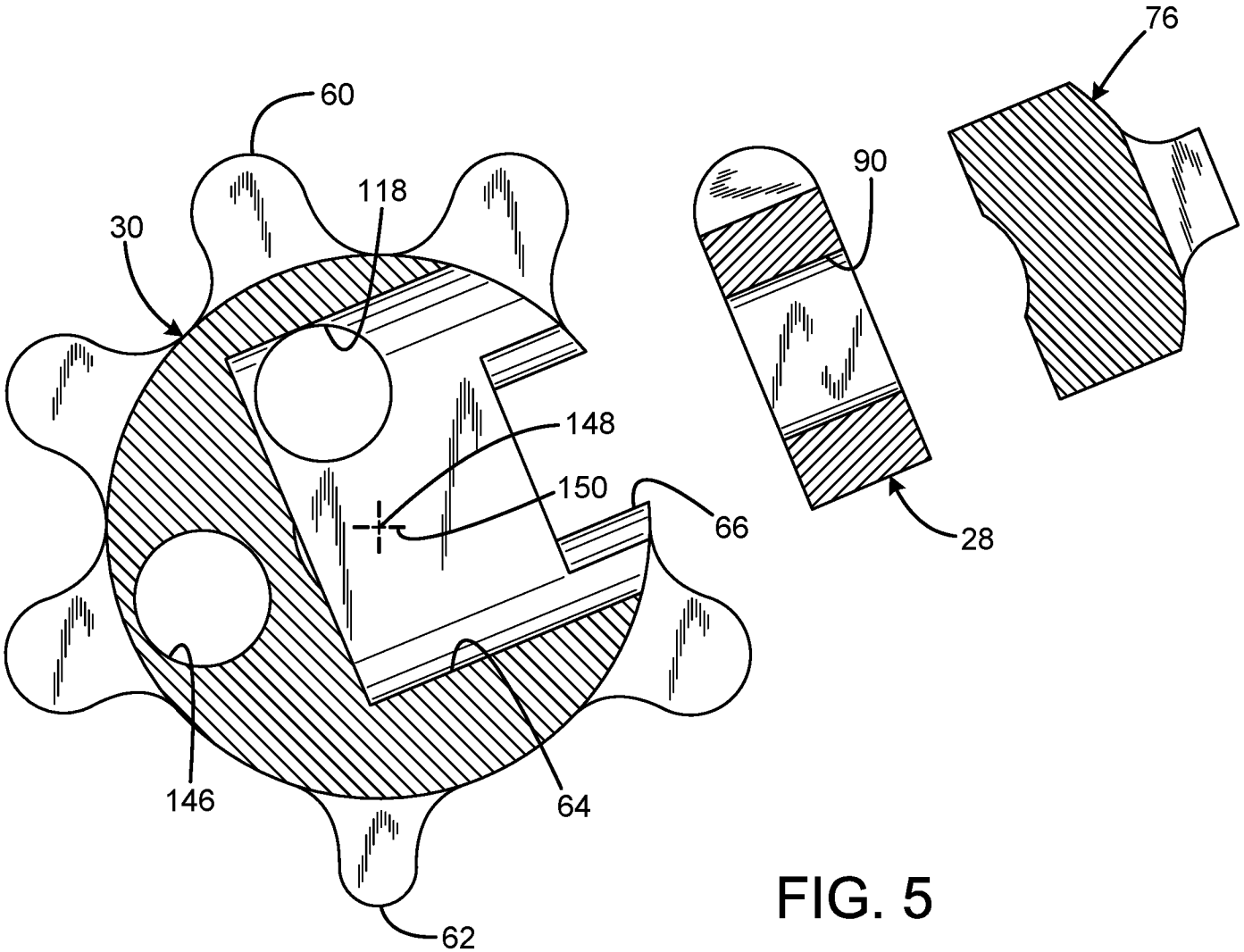
FIG. 5 is a rear sectional view taken along line 5-5 of FIG. 4.
Figure 6:
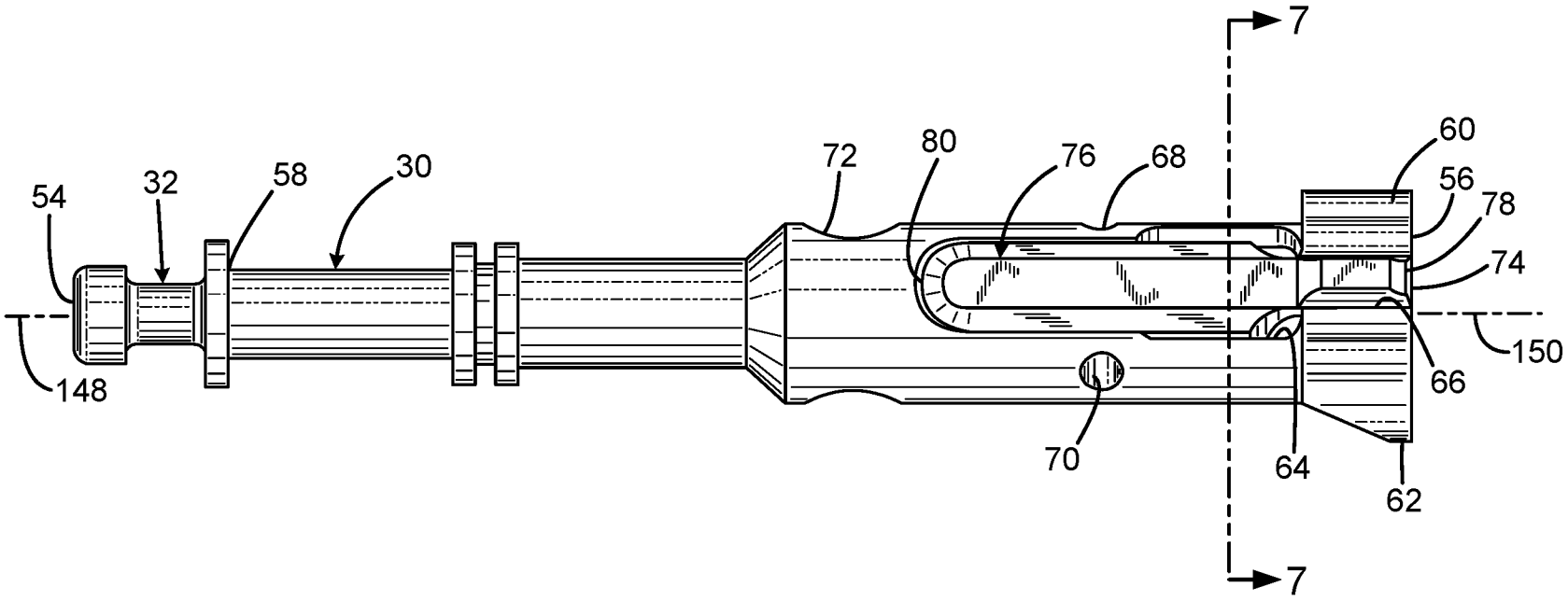
FIG. 6 is an enlarged right side view of the assembled primary firing pin, offset firing pin, and bolt of FIG. 3.
Figure 7:
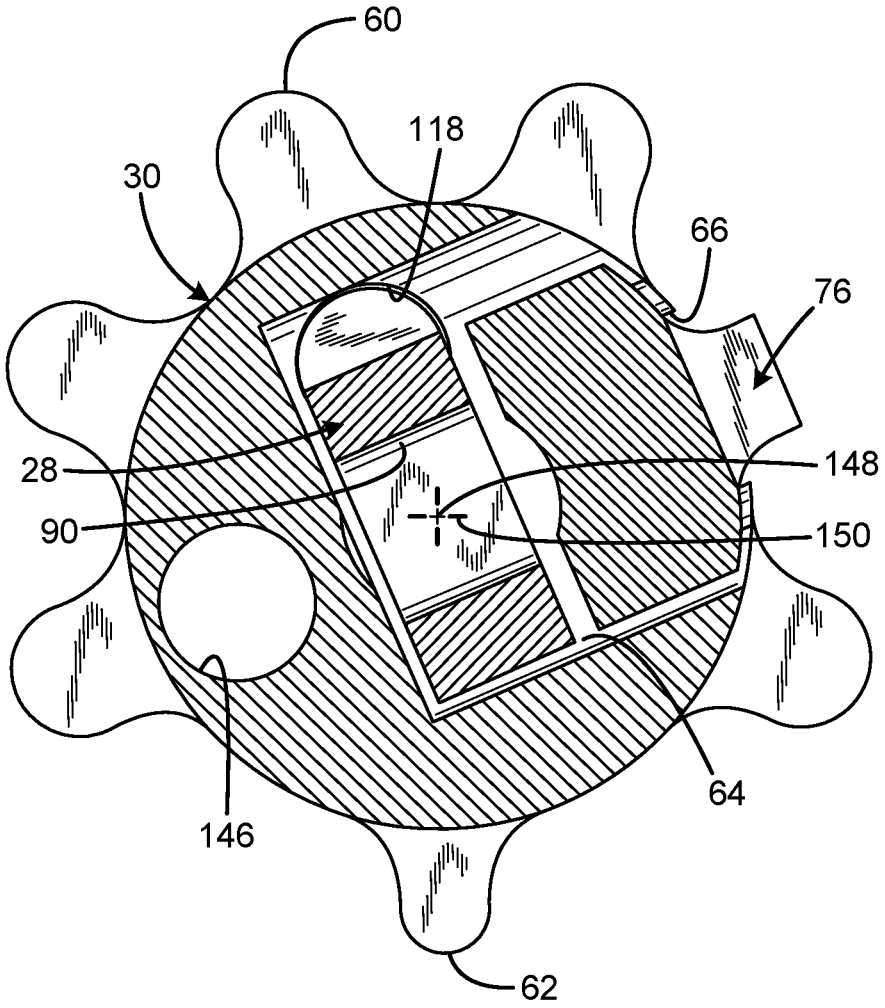
FIG. 7 is a rear sectional view taken along line 7-7 of FIG. 6.
Figure 8:
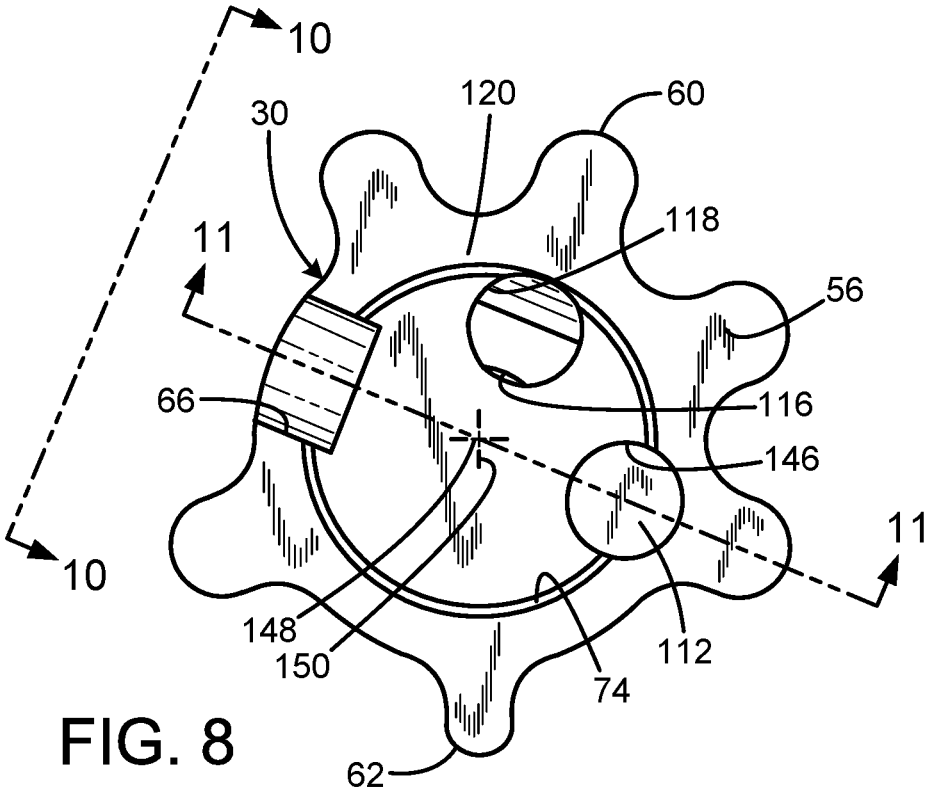
FIG. 8 is a front view of the bolt of FIG. 1.

The offset firing pin 28 has a front 86 and a rear 88. The rear of the offset firing pin defines a rearward opening slot 90. As is shown in FIGS. 5 and 7, the offset firing pin is inserted through the recess 64 in the bolt 30 with the front 86 aligned with the offset firing pin bore 116. The extractor 76 is subsequently connected to the bolt. The extractor permits the offset firing pin to reciprocate within the offset firing pin bore and recess, but otherwise limits the motion of the offset firing pin to retain the front of the firing pin in axial alignment with the offset firing pin bore.

The primary firing pin 32 is an elongated rod having a front 52 and a rear 54, and defines a primary firing pin axis 148. To facilitate traditional disassembly of the bolt carrier assembly 18, the primary firing pin must enter the primary firing pin bore 116 from the rear 58 of the bolt 30. Because of the gas system used to operate the bolt carrier assembly, which will be described subsequently, the primary firing pin must also be concentric with the bolt. However, this position of the primary firing pin would cause the front 52 of the primary firing pin to contact the center of the cartridge 26 instead of the required striking position at rim 122. Therefore, the slot 90 in the rear 88 of the offset firing pin 28 receives the front of the primary firing pin. The front 86 of the offset firing pin is offset so the front of the offset firing pin contacts the rim of the cartridge, thus impacting the primer contained therein and causing the powder charge within the cartridge to ignite.

The barrel 22 has a shoulder 94 at the rear 92 that defines a reduced radius threaded portion 96. A rear support ring protrusion 98 extends rearward beyond the threaded portion. The rear support ring protrusion has a cylindrical shoulder 102 and an angled extractor relief 100.

The barrel extension 40 has a front 104 and a rear 106. The front of the exterior 108 forms a flange 110. An indexing pin 42 received in an aperture (not shown) in the upper receiver 12 extends vertically immediately behind the flange.

Figure 9:
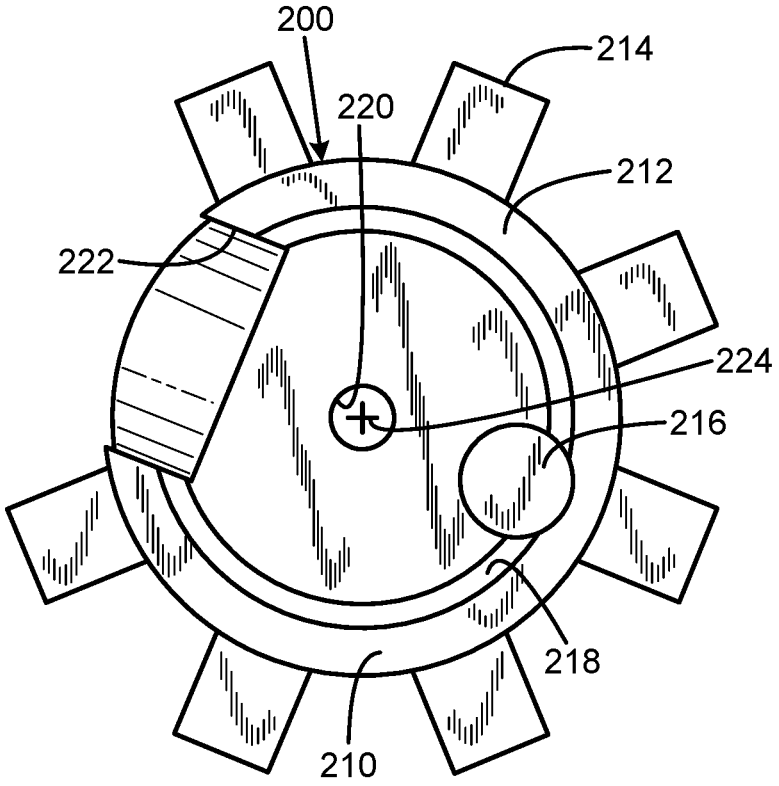
FIG. 9 PRIOR ART
FIG. 9 is a front view of a prior art bolt from an AR-15 rifle.
Figure 10:
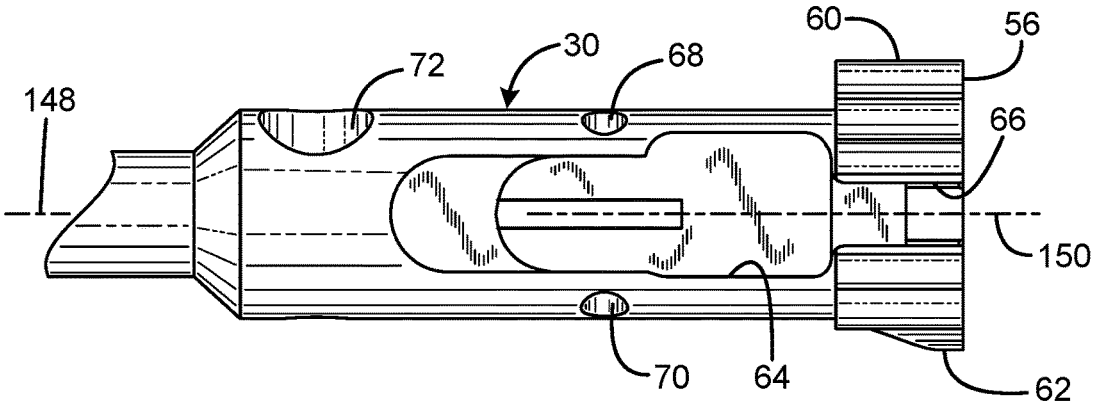
FIG. 10 is a side view of the bolt taken along line 10-10 of FIG. 8.
Figure 11:
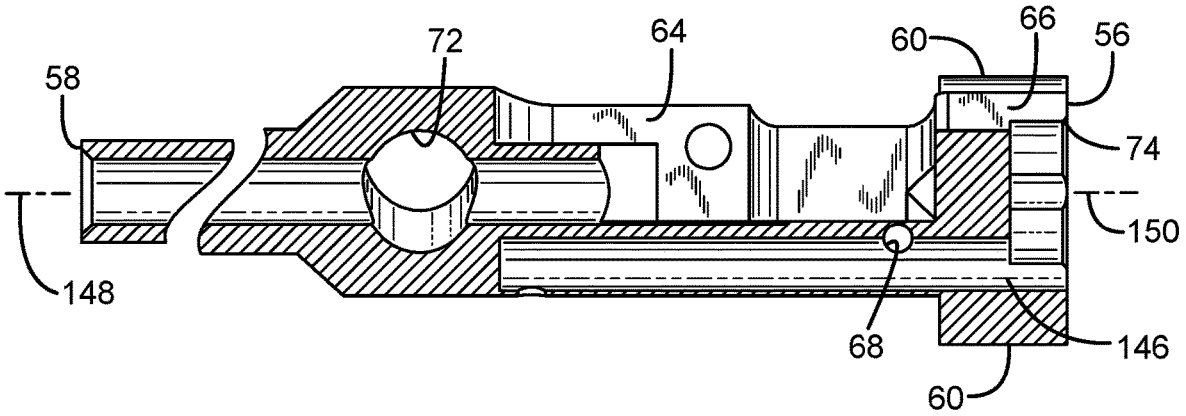
FIG. 11 is a side sectional side view of the bolt taken along line 11-11 of FIG. 8.

FIG. 9 illustrates a prior art standard AR-15 rifle bolt 200. More particularly, the prior art bolt 200 has a front 210, a bolt face 212, seven lugs 214, an ejector 216, a bolt face recess 218, a firing pin bore 220, an extractor slot 222, and defines a bolt axis 224. In comparison with FIG. 6, which shows the front 56 of the bolt 30 of the current invention, the prior art bolt 200 has numerous sharp corners. These create the potential for stress cracking resulting from stress concentration in small-radius areas and create manufacturing challenges. In contrast, the radiused lugs of the bolt of the current invention greatly dissipate stress and are much easier to manufacture. In addition, the bolt face recess 74 of the current invention is more recessed than the bolt face recess 218 to allow for the more rearwardly protruding rimfire cartridge 26 compared to the conventional centerfire cartridge used with a standard AR 15 rifle.

Figure 12:
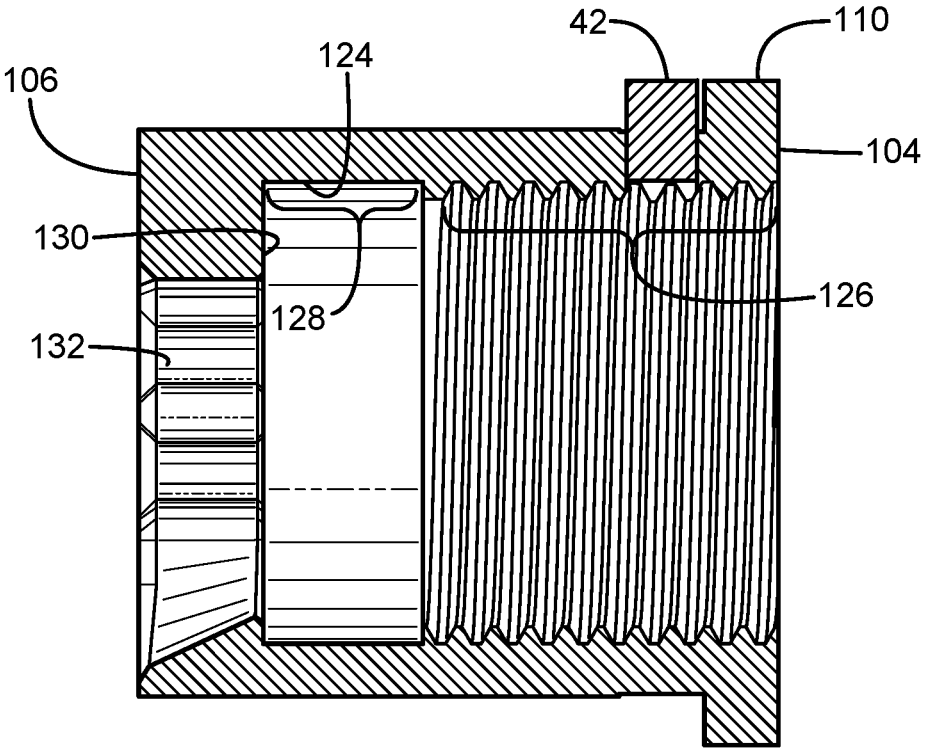
FIG. 12 is a left side sectional view of the barrel extension of FIG. 1.

FIG. 12 illustrates the improved barrel extension 40 of the present invention. More particularly, the barrel extension has a central bore 124 extending from the front 104 to the rear 106. The central bore has a forward threaded portion 126 and a rearward smooth wall portion 128. A shoulder 130 defines a transition to a narrower radiused rearward portion including five lug grooves 132, an extractor groove 134, and an enlarged lug groove 136 (shown in FIGS. 11-12). The threaded portion 126 threadedly engages with the threaded portion 96 in the rear of the barrel 22 to connect the barrel extension to the barrel. The radiused lug grooves in the barrel extension have the same advantages for stress reduction as do the radiused lugs of the bolt 30. The chamfer at the rear edge of the lug grooves can also be added in one step without moving the barrel extension out of the jig used when the lug grooves are initially cut, which makes manufacturing more efficient.

Figure 13:
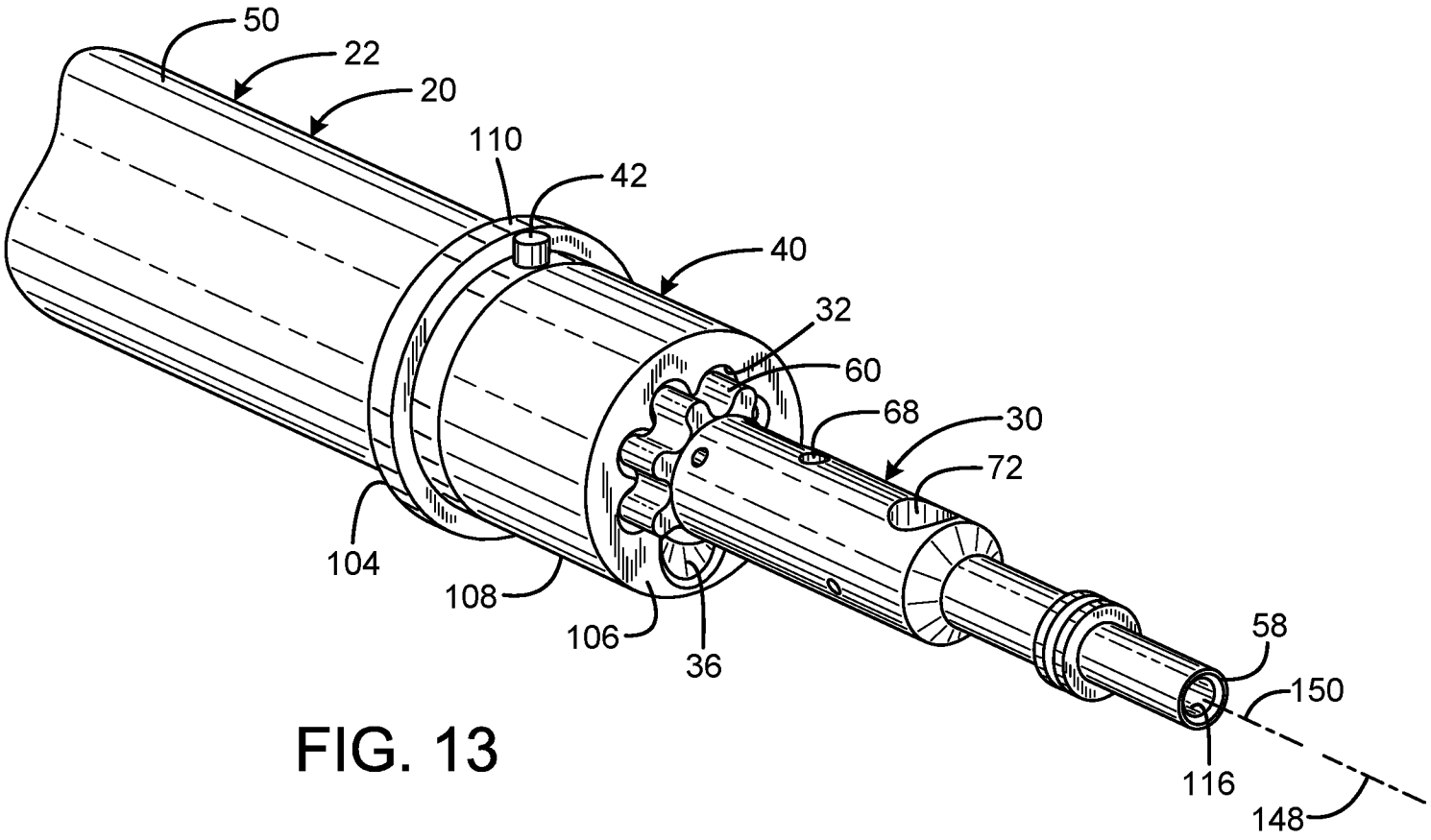
FIG. 13 is a rear isometric view of the bolt entering the barrel assembly of FIG. 1.
Figure 14:
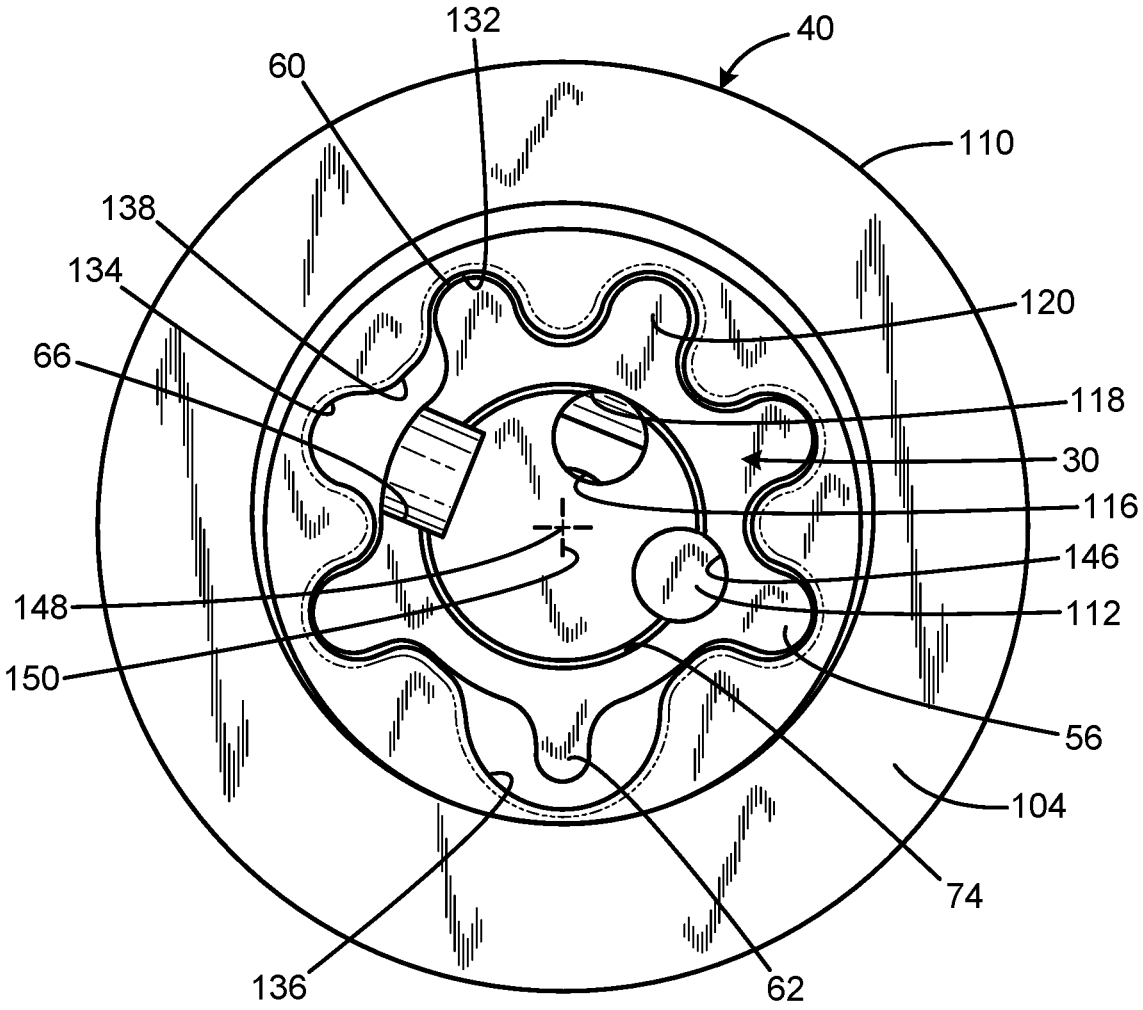
FIG. 14 is a front view of the bolt entering the barrel extension of FIG. 1.

FIGS. 13 and 14 illustrate the improved bolt 30 and barrel assembly 20 of the present invention. More particularly, the bolt is shown entering the rear 106 of the barrel extension 40. The lugs 60 on the bolt are axially aligned with the lug grooves 132 in the barrel extension, the bottom lug 62 is axially aligned with the enlarged lug groove 136 in the barrel extension, and the extractor slot 66 is aligned with the extractor groove 134. The protrusion 138 separating the extractor groove from the adjacent lug groove is shorter to provide adequate clearance for the front 78 of the extractor 76 to enter the rear of the barrel extension. The bottom lug 62 is smaller than the lugs 60 and functions to strip a new cartridge 26 from the magazine. The enlarged lug groove is much larger than the lug grooves 132 and acts as a ramp to guide the cartridge into the central bore 124 in the barrel extension 40. As the bolt continues to move forward into the barrel extension, the cam pin 34 causes the bolt to rotate within the bolt carrier 38, thereby locking the bolt into place within the barrel extension in a conventional manner.

Figure 15:
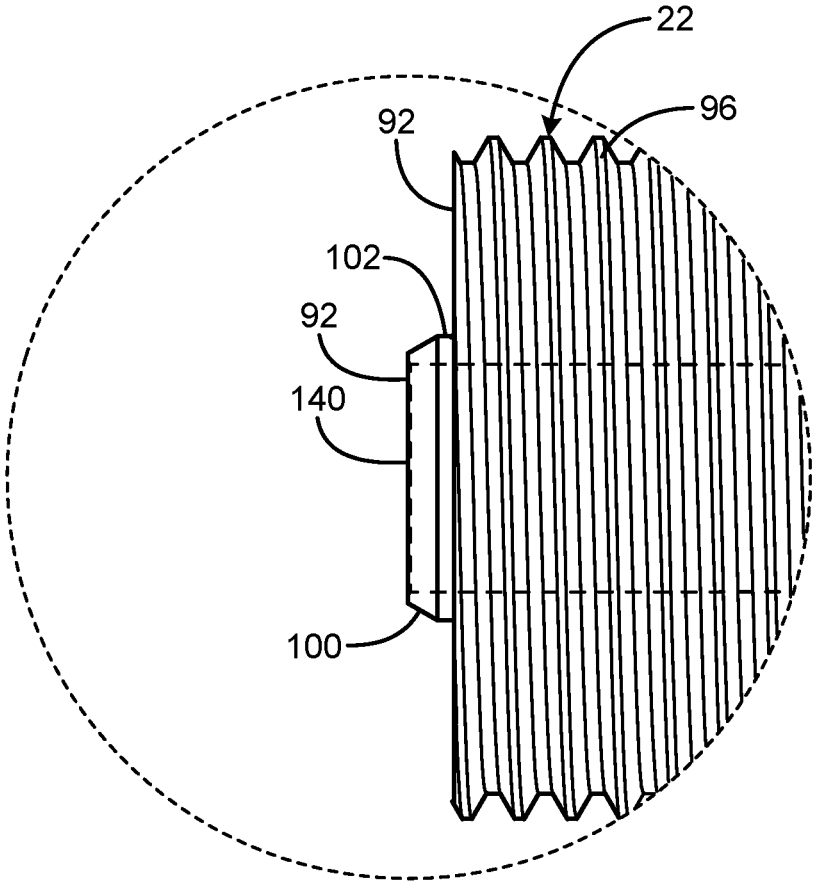
FIG. 15 is an enlarged view of the circled area 15 of FIG. 3.

FIG. 15 illustrates the improved rear support ring protrusion 98 from the rear 92 of the barrel 22 of the present invention. More particularly, the rear support ring protrusion has an 11:20 wall thickness to extrusion length ratio in the current embodiment to ensure adequate strength, with a wall thickness of 0.034 inch, an outer diameter of 0.339 inch, and a length of 0.062 inch. The rear support ring protrusion is sized such that the rear support ring protrusion can be received within the bolt face recess 74 to support the wall of the cartridge 26 while the rifle 10 is in battery. Sufficient cartridge support is essential for safe operation of the rifle since the cartridge experiences a peak operating pressure of 33,000 psi. The extractor relief 100 is cut at a 30° angle in the current embodiment. To further ensure adequate strength of the rear support ring protrusion in the current embodiment, 4140 steel is used, and the rear support ring protrusion is tempered via heat treatment. A nitride salt bath is subsequently used to provide increased wear resistance.

The extractor relief 100 is cut 360° around the entire breech face 140 at the rear 92 of the barrel 22 so the relief cut for the extractor 76 does not have to be indexed at a specific position relative to the threaded barrel extension 40. Since the barrel extension is screwed onto the barrel in a precise matter in order to accurately set headspace for the cartridge 26, it is much easier for the extractor cut to allow room for the extractor irrespective of the angle of the barrel extension relative to the rear protrusion 98. If the 360° extractor relief were not utilized, the barrel extension would have to be threaded onto the barrel until proper headspace was achieved. Then a 30° extractor relief would have to be demarcated on the breech face. The barrel extension would then have to be removed, and the barrel would then be jigged up on a mill so the 30° extractor cut could be made. Then the barrel extension would have to be reinstalled onto the barrel while double checking the headspace. Finally, the extractor's operation would have to be examined to confirm the extractor had full, unrestricted rotation along the breech face. By instead having the extractor relief cut along all 360° of the breech face, the extractor can operate at any angle that it is positioned by the barrel extension. This saves considerable time in manufacturing and prevents waste associated with incorrectly cut or indexed barrels.

Figure 16:
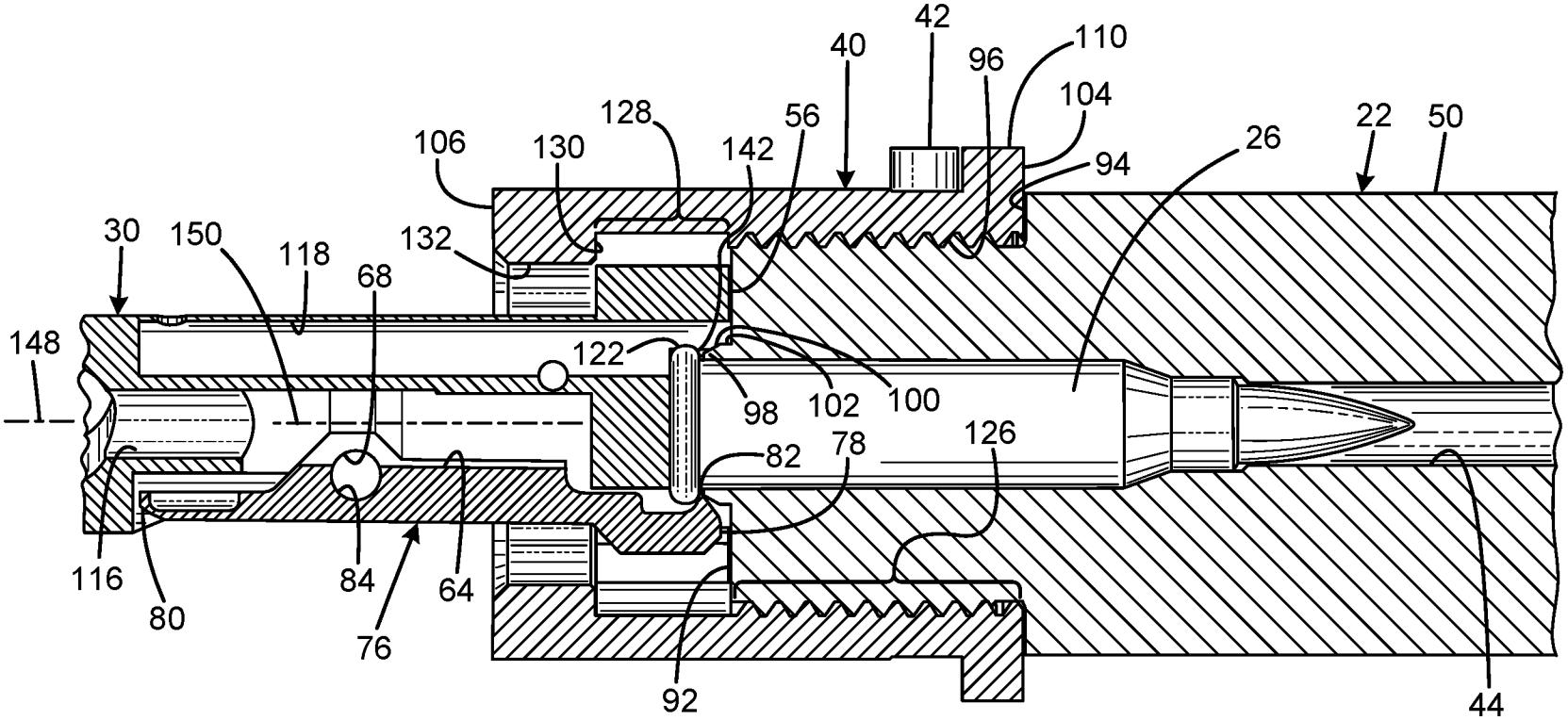
FIG. 16 is an enlarged fragmentary view of the bolt at the initiation of cartridge extraction from the barrel assembly of FIG. 1.

FIG. 16 illustrates the improved extractor 76 and rear protrusion 98 of the present invention. More particularly, the extractor relief 100 enables the hook 82 on the front 78 of the extractor to engage the forward face 142 of the rim 122 of the cartridge 26. This can occur because extractor relief creates a groove between the cartridge rim and the threaded portion 96 of the barrel that permits the extractor to extend beyond the breech face.

The improved bolt carrier assembly 18 and barrel assembly 20 of the present invention, when installed in a conventional AR-15 rifle upper receiver 12 that is connected to a conventional AR-15 rifle lower receive 14, convert the conventional AR-15 centerfire rifle into the semi-automatic rimfire rifle 10 of the present invention. In use, when the trigger 16 is pulled to discharge the rifle 10, the front edge of the trigger moves downward, disengaging the hammer 50 from the trigger. The hammer spring (not shown) can then drive the hammer forward into the rear 54 of the primary firing pin 32. Contact between the hammer and primary firing pin urges the primary firing pin forward, which also urges the offset firing pin 28 connected to the front 52 of the primary firing pin forward. This action causes the front 86 of the offset firing pin, which is laterally offset from the bolt axis 150, to impact the primer in the rim 122 of the cartridge 26, thus causing the powder charge contained within the cartridge to ignite.

The powder ignites, causing a rapid buildup of pressure inside the cartridge 26, until the pressure overcomes the press fit of the bullet in the cartridge. The pressure expels the bullet from the cartridge, and the bullet travels forward in the barrel bore 44 towards the muzzle 24. As the bullet travels forward in the barrel 22, pressurized gas remains trapped behind the bullet. Once the bullet passes the gas port 46, a portion of the pressurized gas escapes into the gas piston chamber (not shown). The pressurized gas accumulates within the piston chamber until sufficient pressure is achieved to force the piston (not shown) rearward. This rearward linear motion is transferred to the bolt carrier via the piston operating rod (not shown). The cam pin 34 causes the bolt to rotate inside the bolt carrier as the bolt carrier moves rearward, which unlocks the bolt from the rear 106 of the barrel extension 40.

As the bolt carrier assembly 18 is driven rearward, it cocks the hammer 50 to prepare the rifle 10 to be fired again. The bolt 30 also pulls the empty cartridge 26 rearwards because the extractor 76 has gripped the rim 122 of the cartridge. The ejector 112 inside the bolt pushes forward on the empty cartridge on the left side. This action urges the empty cartridge rightwards. Once the empty cartridge has been pulled rearwards sufficiently to fit through the ejection port, the empty cartridge ejects from the rifle 10.

When all of the rearward momentum has been exhausted, the buffer spring (not shown) urges the bolt carrier assembly 18 forward. As the bolt carrier assembly moves forward, the next cartridge 26 has been pushed to the top of the magazine 144 by the magazine spring (not shown), and the bottom lug 62 of the bolt 30 strips the cartridge from the magazine and drives it forward via the enlarged groove 136 in the rear 106 of the barrel extension 40 into a chamber defined by the rear 92 of the barrel bore 44 and the central bore 124 of the barrel extension 40. As the bolt is driven forward into the chamber, the bolt is also rotated and locked by the action of the cam pin 34.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a semi-automatic rimfire rifle has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although an AR-15 is disclosed, the invention is suitable for use with a wide variety of firearm platforms including the AK-47, FN-FAL, Mini-14, UZI, M1A, Garand, and Remington 740, 7400, and 750.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame;

a barrel having a forward muzzle end and rear breech end attached to the frame;

the barrel defining a chamber in a breech face at the rear breech end;

the breech face defining a breech face plane;

a support ring protrusion surrounding the chamber and protruding rearwardly from the breech face plane;

the protrusion having a forward cylindrical portion adjacent to the breech face plane; and wherein the support ring protrusion has a wall thickness measured in a radial direction from the chamber less than its protrusion amount; and wherein the annular rear face of the support ring protrusion has a wall thickness less than or equal to 0.034 inch.

2. The firearm of claim 1 wherein the support ring protrusion includes an interior, the chamber includes an interior, and the interior of the support ring protrusion is coextensive with the interior of the chamber.

3. A firearm comprising:

a frame;

a barrel having a forward muzzle end and rear breech end attached to the frame;

the barrel defining a chamber in a breech face at the rear breech end;

the breech face defining a breech face plane;

a support ring protrusion surrounding the chamber and protruding rearwardly from the breech face plane;

the protrusion having a forward cylindrical portion adjacent to the breech face plane; and wherein the support ring protrusion has a wall thickness measured in a radial direction from the chamber less than its protrusion amount; and wherein the support ring protrusion has a tapered exterior.

4. The firearm of claim 3 wherein the support ring protrusion includes an interior, the chamber includes an interior, and the interior of the support ring protrusion is coextensive with the interior of the chamber.

5. A firearm comprising:

a frame;

a barrel having a forward muzzle end and rear breech end attached to the frame;

the barrel defining a chamber in a breech face at the rear breech end;

the breech face defining a breech face plane;

a support ring protrusion surrounding the chamber and protruding rearwardly from the breech face plane;

the protrusion having a forward cylindrical portion adjacent to the breech face plane; and wherein the support ring protrusion has a wall thickness measured in a radial direction from the chamber less than its protrusion amount; and wherein the support ring protrusion has a buttressed cross-section with a straight interior and a tapered exterior.

6. The firearm of claim 5 wherein the support ring protrusion includes an interior, the chamber includes an interior, and the interior of the support ring protrusion is coextensive with the interior of the chamber.

* * * * *